US005576264A

United States Patent [19]

Ueno et al.

[11] Patent Number: 5,576,264

[45] Date of Patent: Nov. 19, 1996

[54] RECEIVING-LAYER TRANSFER SHEET

[75] Inventors: Takeshi Ueno; Yoshinori Nakano; Ryohei Takiguchi, all of Tokyo-To, Japan

[73] Assignee: Dai Nippon Printing Co., Ltd., Japan

[21] Appl. No.: 345,746

[22] Filed: Nov. 22, 1994

[30] Foreign Application Priority Data

| | | | |
|---|---|---|---|
| Nov. 24, 1993 | [JP] | Japan | 5-315778 |
| Nov. 24, 1993 | [JP] | Japan | 5-315779 |
| Jan. 17, 1994 | [JP] | Japan | 6-015694 |

[51] Int. Cl.[6] ..... B41M 5/035; B41M 5/38

[52] U.S. Cl. ..... 503/227; 428/195; 428/206; 428/913; 428/914

[58] Field of Search ..... 8/471; 428/195, 428/913, 914, 206; 503/227

[56] References Cited

FOREIGN PATENT DOCUMENTS

| | | | |
|---|---|---|---|
| 61-141140 | 6/1986 | Japan | 503/227 |
| 62-297184 | 12/1987 | Japan | 503/227 |
| 3-107892 | 5/1991 | Japan | 503/227 |
| 4-336287 | 11/1992 | Japan | 503/227 |

*Primary Examiner*—B. Hamilton Hess
*Attorney, Agent, or Firm*—Parkhurst, Wendel & Burr

[57] ABSTRACT

A receiving layer transfer sheet including a substrate film, and a transferable resin layer formed on one surface of the substrate film and composed of at least a dye receiving layer component and an adhesive layer component, wherein the dye receiving layer and adhesive layer components are formed on the substrate film in this order, if desired, with an additional layer component interleaved therebetween, and at least one layer component forming the transferable resin layer contains a foam and/or a foaming agent and the adhesive layer component includes a mixture of at least two heat-sensitive adhesive materials having varying softening temperatures. Additionally, a receiving layer transfer sheet including a substrate film, and a transferable resin layer formed on one surface of the substrate film and composed of at least a dye receiving layer component and an adhesive layer component, wherein the dye receiving layer and adhesive layer components are formed on the substrate film in this order, if desired, with an additional layer component interleaved therebetween, and the dye receiving layer component has a thickness in the range of 0.1 μm to 1.0 μm and contains a filler. Additionally, a receiving layer transfer sheet including a substrate film, and a transferable resin layer formed on one surface of the substrate film and composed of at least a dye receiving layer component and an adhesive layer component, wherein the dye receiving layer and adhesive layer components are formed on the substrate film in this order, if desired, with an additional layer component interleaved therebetween, and the total amount of solvent residues in the transferable resin layer is up to 200 mg/m$^2$.

23 Claims, 1 Drawing Sheet

RECEIVING-LAYER TRANSFER SHEET

BACKGROUND OF THE INVENTION

The present invention relates to a receiving layer transfer sheet, and more specifically to a receiving layer transfer sheet used to form a color image of high quality by thermal transfer recording methods.

Among various thermal transfer methods so far proposed and known in the art, there is a method for forming various full-color images on a thermal transfer image receiving sheet such as paper or plastic film including a dye receiving layer thereon, using a thermal transfer sheet made up of a substrate film such as paper or plastic film on which a sublimable dye is carried as a recording agent. This method uses a printer's thermal head as heating means, and enables a multiplicity of three- or four-color dots to be transferred onto the thermal transfer image receiving sheet by very short heating, thereby reproducing a full-color image of the original with said multi-color dots.

The thermal transfer image receiving sheet that enables image formation to be achieved by the method mentioned above is limited to a dyeable plastic sheet, or a paper or other sheet with a dye receiving layer preformed thereon; that is, there is a grave problem that any image cannot directly be formed on generally available plain paper or other sheets.

Of course, images may be formed even on general plain paper, provided that it has a receiving layer on the surface. However, this does not only cost much but also has difficulty in application to generally available materials onto which images are to be transferred, for instance, postcards, letter paper, and pads for note-taking, reporting and other purposes.

One known approach to solving these problems is to use a receiving layer transfer sheet designed to enable a dye receiving layer to be easily provided only on the necessary portion of an associated or cooperative member made of generally available plain paper or other material. In this regard, see JP-A 62-264994.

Another approach known for additional convenience is to make use of a receiving layer transfer sheet made up of a continuous substrate film having yellow, cyan and magenta dye layers possibly with a black dye layer formed successively on the surface in this order and in the longitudinally direction, and including a dye receiving layer on the same film surface. The receiving layer is first transferred onto a cooperative member, and the respective dye layers are subsequently transferred onto the receiving layer to form a full-color image. Still another receiving layer transfer sheet having on the surface a protective layer for protecting the formed dye image is proposed as well.

However, all conventional receiving layer transfer sheets have problems each awaiting solution, as set forth below.

(a) The transferable resin layer of one typical conventional receiving layer transfer sheet is essentially required to include a dye receiving layer and an adhesive layer laminated on its substrate sheet surface, on which additional layers such as release and intermediate layers are co-laminated as occasion demands. At least one layer contains foams or a foaming agent for the purpose of improving image quality. However, the incorporation of foams or a foaming agent gives rise to increases in the heat insulation and total thickness of the transfer layer, which otherwise makes the transmission of transfer heat unsmooth, often resulting in a transfer failure. When this receiving layer transfer sheet is used to transfer the transferable receiving layer onto a postcard, plain paper or other substrate sheet, the transfer function depends primarily on the adhesion properties of the adhesive layer. For instance, by use of an adhesive material having a relatively low softening temperature it is possible to achieve a pattern form of transfer as by a thermal head with relatively low energy. However, the use of an adhesive material having a low softening temperature offers a blocking problem when the receiving layer transfer sheet is stored, especially in a rolled-up state. When used within the printer over an extended period of time, this blocking problem becomes serious due to a temperature increase within the printer.

These problems may be easily solved by use of an adhesive material having a relatively high softening temperature. When a thermal head is used for transfer, however, excessive heat energy is needed, making the durability of the thermal head worse. In addition, this adhesive material fails to produce its own adhesion at the initial stage of transfer at which the interior temperature of the printer remains low, often resulting in transfer defects such as "chipping" or "dropping-out" of a transferred layer. As the interior temperature of the printer increases with time, on the other hand, another problem arises; that is, the surface of the dye receiving layer to be transferred comes to having fine asperities corresponding to the printing pressure of the thermal head.

Therefore, the first object of the present invention is to provide a receiving layer transfer sheet which is free from any blocking problem during storage or in use and enables good-enough transfer to be achieved by application of relatively low energy, and the transferability of which is not affected by a temperature change in a printer, thus making homogeneous transfer and the formation of high-quality images possible.

(b) Usually, the transferable resin layer of another typical conventional receiving layer transfer sheet is essentially required to include a dye receiving layer and an adhesive layer laminated on its substrate sheet surface, on which additional layers such as releasing, barrier and foamed layers are co-laminated as occasion demands. The transferable resin layer is transferred by various techniques onto a suitable cooperative member such as paper. When the resin layer is transferred onto the cooperative member in a desired pattern by means of heating with a thermal head, however, it is required that the resin layer be precisely transferred in a desired form.

It is here to be noted that the intermediate layer such as a foamed layer and the adhesive layer forming part of the transferable resin layer are made of resins of low strength, but the dye receiving layer is made of a thermoplastic resin of relatively high strength and heat resistance for the purpose of obtaining image stability upon image formation. This makes it impossible to achieve transfer of a precise pattern by a thermal head, and so offers a grave problem; that is, the transferred resin layer have zigzag edges or, in the alternative, it has some transfer defects represented by "tailing".

Therefore, the second object of the present invention is to provide a receiving layer transfer sheet which, upon transfer, can be cut off by a thermal head in a precise and easy manner and enables high-quality images to be formed.

(c) Usually, the transferable resin layer of the typical conventional receiving layer transfer sheet is essentially required to include a dye receiving layer and an adhesive layer laminated on its substrate sheet surface, on which additional layers such as release, barrier and foamed layers are co-laminated as occasion demands. In most cases, these layers are formed by the coating and drying of coating solutions having a suitable resin dissolved in an organic solvent. Ideally, all the solvents must be evaporated off upon drying. Usually, however, perfect removal of the solvents is not industrially advantageous if the solvent composition, ability-to-be-coated, productivity, and other factors of the coating solutions are taken into account; that is, it is unavoidable that some amounts of the solvents remain in the transferable resin layer. It is of course preferable that such solvent residues are reduced as much as possible. In other words, a problem associated with the properties and productivity of coating solutions is to what degree the amount of solvent residues is acceptable.

Too much solvent residues offer many problems. For instance, the receiving layer cannot be cut off upon transfer, the receiving layer cannot be transferred in a precise form, the receiving layer is transferred with "tailing" and with poor releasability, the receiving layer fuses and sticks fast to the dye layer of a thermal transfer sheet upon image formation after transfer, and the formed image degrades with time. Especially in the case of a composite thermal transfer sheet including a dye layer, solvent residues migrate into the dye layer, having an adverse influence on the dye of the dye layer.

As a matter of course, the problems mentioned above may be solved by imposing strict limitations on the conditions for drying coating solutions after coating. However, such a solution is industrially unpractical, because a very time-consuming drying procedure is needed, and because much difficulty is involved in foaming control when microcapsules in the foamed layer are kept unfoamed.

Therefore, the third object of the present invention is to provide a receiving layer transfer sheet which, while the amount of solvent residues in a transferable resin layer and productivity are well balanced, and enables the transferable resin layer to be well transferred without offering the problems mentioned above even in the presence of solvent residues, thereby making the formation of high-quality images possible.

SUMMARY OF THE INVENTION

First Aspect

The first object mentioned above is achieved by the following invention.

The first aspect of the invention relates to a receiving layer transfer sheet comprising a substrate film, and a transferable resin layer having at least a dye receiving layer component and an adhesive layer component formed on one surface of said substrate film, wherein:

said dye receiving and adhesive layer components are formed on said substrate film in this order, if desired, with an additional layer interposed or interleaved therebetween, at least one layer component forming said transferable resin layer contains a foam and/or a foaming agent, and said adhesive layer component is made up of a mixture of at least two heat-sensitive adhesive materials having varying softening temperatures.

The adhesive layer component of the receiving layer transfer sheet with the transferable resin layer containing foams (or a foaming agent) is made up of at least two heat-sensitive adhesive materials varying in softening temperature. This eliminates the blocking problem and makes the range of reasonable adhesion temperature wide so that, even at the initial stage of transfer, good-enough transfer can be achieved by application of relatively low energy. In addition, the transferability of the transferable resin layer is not affected even by a temperature increase in a printer, thereby making homogeneous transfer and the formation of high-quality images possible.

Second Aspect

The second object mentioned above is achieved by the following aspect of the invention.

The second aspect of the invention relates to a receiving layer transfer sheet comprising a substrate film, and a transferable resin layer having at least a dye receiving layer component and an adhesive layer component formed on one surface of said substrate film, wherein:

said dye receiving and adhesive layer components are formed on said substrate film in this order, if desired, with an additional layer interposed or interleaved therebetween, and said dye receiving layer component has a thickness lying in the range of 0.1 μm to 1.0 μm and contains a filler.

By allowing the dye receiving layer component of the transferable resin layer of the receiving layer transfer sheet to have a thickness lying in the range of 0.1 μm to 1.0 μm and contain a filler it is possible to cut off the resin layer with a thermal head and form an image of high quality.

Third Aspect

The third object mentioned above is achieved by the following aspect of the invention.

The third aspect of the invention relates to a receiving layer transfer sheet comprising a substrate film, and a transferable resin layer having at least a dye receiving layer component and an adhesive layer component formed on one surface of said substrate film, wherein:

said dye receiving and adhesive layer components are formed on said substrate film in this order, if desired, with an additional layer interposed or interleaved therebetween, and the total amount of solvent residues in said transferable resin layer is up to 200 $mg/m^2$.

By allowing the total amount of solvent residues in the transferable resin layer of the receiving layer transfer sheet to be reduced to 200 $mg/m^2$ or less it is possible to achieve good-enough transfer of the transferable resin layer without sacrificing productivity while the problems mentioned above are eliminated, thereby enabling a high-quality image to be formed.

BEST MODE FOR CARRYING OUT THE INVENTION

First Aspect

Figure 1:
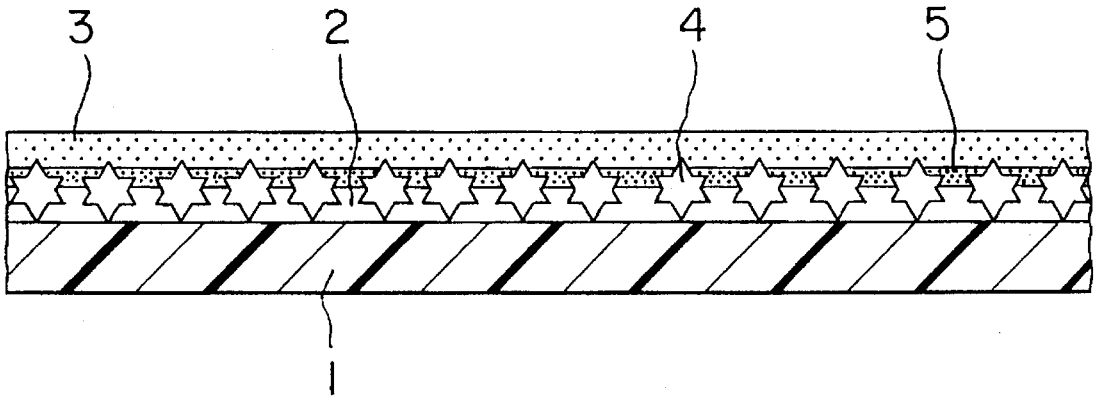
FIG. 1 is a sectional schematic of the receiving layer transfer sheet according to the second aspect of the invention.

The first aspect of the invention will now be explained at great length with reference to some preferred embodiments.

Basically, the receiving layer transfer sheet includes a substrate film having a transferable resin layer comprising a dye receiving layer component and an adhesive layer component formed on its one surface with or without a release layer, at least one of said layer components containing foams (or a foaming agent) and said substrate film having a releasable, heat-resistant lubricating layer component formed on the other surface, and is characterized in that the adhesive layer component of said transferable resin layer is made up of two heat-sensitive adhesive materials varying in softening temperature.

In a preferable embodiment, intermediate layers such as cushion and barrier layers can be interposed between the dye receiving and adhesive layers. At least one of these intermediate layers may contain foams (or a foaming agent). In this case, none of the dye receiving and adhesive layers contain foams.

The receiving layer transfer sheet according to the first aspect of the invention may also be designed as an integral type of composite thermal transfer sheet comprising a substrate film, on one surface of which a dye layer of one color, or dye layers of two or more colors such as yellow, magenta and cyan dye layers, possibly with a black dye layer, and/or a transferable protective layer are formed successively in the longitudinal direction with respect to the transferable resin layer containing the dye receiving layer component.

The term "heat-sensitive adhesive material" used in the present disclosure is understood to refer to a material that is tack-free at normal temperature, but shows tackiness upon softened or melted by heating and sticks fast to an application surface upon solidified by cooling. A number of thermoplastic resins show such behavior as mentioned above.

In a preferable embodiment, two such adhesive materials are mixed together for use, one having a softening temperature of 50° C. to 150° C. and the other a softening temperature of 100° C. to 200° C. Although varying depending on softening temperature, it is general that the weight ratio of the former to the latter is 1:9 to 9:1, preferably 1:1.5 to 2.3:1, more preferably 1:1. When the amount of the adhesive material having a lower softening temperature is too small, the initial transferability becomes insufficient. Too much, on the other hand, causes the blocking problem to remain unsolved.

The two adhesive materials mentioned above are preferably used in such a combination that the softening temperature difference is 10° C. to 50° C. Too small a temperature difference does not make the range of reasonable adhesion temperature wide, whereas too large a temperature difference makes the range of reasonable adhesion temperature too discontinuous to follow precisely a temperature change within a printer, often resulting in "chipping" or "chattering" defects.

In the present invention, foams or a foaming agent are added to at least one of the layer components to be described later for the purpose of improving image quality. It is inter alia preferable to add them to the intermediate or adhesive layer components.

In the present invention, no particular limitation is imposed on the substrate film used; the same substrate film as so far used for conventional thermal transfer sheets is directly used, and other substrate films may be used as well.

Illustrative examples of preferable substrate films are tissue paper films such as those of glassine paper, condenser paper and paraffin paper, and plastic films such as those of polyester, polypropylene, cellophane, polycarbonate, cellulose acetate, polyethylene, polyvinyl chloride, polystyrene, nylon, polyimide, polyvinylidene chloride and ionomer, which may be used in composite forms with the paper films mentioned above.

Substrate film thickness is preferably 3 μm to 100 μm, although it may be varied depending on material to impart suitable properties such as strength and heat resistance thereto.

Preferably, the substrate film mentioned above is provided on the other or back surface with a releasable, heat-resistant lubricating layer for the purposes of not only preventing its fusion with a thermal head and improving its running stability but also preventing its adhesion to the adhesive layer to be described later, when the receiving layer transfer sheet of the invention is rolled up.

The releasable, heat-resistant lubricating layer may be made of a release agent such as curing silicone oil, curing silicone wax, silicone resin, fluorocarbon resin, and acrylic resin, and may be formed at a thickness of about 0.1 μm to about 3 μm as in the case of the dye receiving layer to be described later.

In the receiving layer transfer sheet of the invention, the dye receiving layer formed on the surface of the substrate film mentioned above is to receive the sublimable dye migrating from any thermal transfer image receiving layer upon transfer and maintain the formed image.

Prior to forming the receiving layer (or the protective layer), it is preferable to form a release layer on the surface of the substrate film. Such a release layer is formed of a release agent such as waxes, silicone wax, silicone resin, fluorocarbon resin, and acrylic resin.

The release layer may be formed at a thickness of about 0.5 μm to about 5 μm as in the case of the dye receiving layer. When matting is desired after transfer, the release layer is matted on the surface either by addition of various particles or by use of a substrate film which is matted on the surface on which the release layer is to be formed. When the substrate film mentioned above is of suitable releasability, it is of course unnecessary to form the release layer.

For the resin forming the dye receiving layer, for instance, mention is made of polyolefinic resins such as polypropylene, halogenated polymers such as polyvinyl chloride, vinyl chloride-vinyl acetate copolymers and polyvinylidene chloride, vinyl polymers such as polyvinyl acetate and polyacrylic ester, polyester resins such as polyethylene terephthalate and polybutylene terephthalate, polystyrene resins, poyamide resins, copolymeric resins such as those of olefins such as ethylene or propylene with other vinyl monomers, ionomers, cellulosic resins such as cellulose diacetate, and polycarbonates, with the vinyl and polyester resins being particularly preferred.

The release agent preferably used in admixture with the resin mentioned above, for instance, includes silicone oil, a phosphate surfactant and a fluorine surfactant, with the silicone oil being preferred. Preferably, the silicone oil has been modified or denatured with epoxy, alkyl, amino, carboxyl, alcohol, fluorine, alkyl aralkyl polyether, epoxy-polyether, polyether, etc.

One or two or more such release agents are used. Preferably, such release agents are used in an amount of 0.5 to 30 parts by weight per 100 parts by weight of the dye receiving layer-forming resin. A departure from this range often results in a fusion of the thermal transfer sheet with the dye receiving layer, a lowering of printing sensitivity or other defects. Such release agents, when added to the dye receiving layer, bleed out on the surface of the receiving layer after transfer, thus forming a releasable, heat-resistant lubricating layer. The receiving layer is formed on one surface of the substrate film mentioned above, if required, with the release layer located between them, by the coating of a solution obtained by dissolving the resin mentioned above in a suitable organic solvent together with the required additives or dispersing the resin mentioned above in a suitable organic solvent or water together with the required additives as by gravure or screen printing or, in the alternative, reverse roll coating making use of a gravure plate, followed by drying.

The dye receiving layer formed as mentioned above may have any desired thickness, but has generally a thickness of 1 μm to 10 μm. While such a dye receiving layer is preferably a continuous coating, it is understood that it may be formed into a discontinuous coating by use of resin emulsion or resin dispersion techniques.

In the present invention, an adhesive layer is provided on the surface of the receiving layer mentioned above so as to improve its transferability. The adhesive layer is formed by mixing together two adhesive materials that are tack-free at normal temperature but show adhesive force only upon heated, as already mentioned.

For the heat-sensitive adhesive materials mentioned above, for instance, use may be made of thermoplastic resins having varying softening points such as polyurethane resins, polystyrene resins, styrene-acrylic copolymer resins, polyamide resins, acrylic resins, vinyl chloride resins, and vinyl chloride-vinyl acetate copolymer resins. Resins having suitable softening temperatures are selected from these thermoplastic resins and used in combination with each other. Preferably, the adhesive layer has a thickness of about 0.5 μm to about 10 μm upon formed.

According to the present invention, if desired, an additional intermediate layer or layers may be provided between the aforesaid receiving layer and the above-mentioned adhesive layer. For instance, the intermediate layers are formed of polyurethane, acrylic, polyethylene or epoxy resins, and butadiene rubbers. The intermediate layers have preferably a thickness of about 2 μm to about 10 μm upon formed as in the case of the aforesaid receiving layer. Foams (or a foaming agent) are incorporated in at least one of the receiving, adhesive and intermediate layers mentioned above. The foams (or foaming agent) function to provide the receiving layer with a satisfactory cushion, but has a possibility of making transfer of the transferable resin layer unlikely to occur.

White pigments and fluorescent brighteners may additionally be incorporated in the receiving, adhesive and intermediate layers mentioned above. The white pigments and fluorescent brighteners aid to improve the whiteness of the receiving layer upon transfer and conceal the pale yellow of paper that is a thermal transfer image receiving sheet. These additives inclusive of foams (foaming agent) may have been incorporated in the coating solutions used to form the respective layers.

In the receiving layer transfer sheet according to the present invention, dye layers may be formed successively on the surface of the substrate film at a given interval in the longitudinal direction thereof. Each of such dye layers is a layer in which the dye is carried by any desired binder resin. No particular limitation is placed on the dye used, because all dyes used for known thermal transfer sheets can be well used. By way of example but not by way of limitation, MS Red G, Macrolex Red Violet R, Ceres Red 7B, Samaron Red HBSL and Resolin Red F3BS are mentioned for red dyes; Phorone Brilliant Yellow 6GL, PTY-52 and Macrolex Yellow 6G for yellow dyes; and Kayaset Blue 714, Vaccsoline Blue AP-FW, Phorone Brilliant Blue S-R and MS Blue 100 for blue yellow.

All resins so far known in the art may be used as the aforesaid binder resin for carrying the dye. However, preference is given to cellulosic resins such as ethyl cellulose, hydroxyethyl cellulose, ethyl hydroxycellulose, hydroxypropyl cellulose, methyl cellulose, cellulose acetate and cellulose acetobutyrate, vinyl resins such as polyvinyl alcohol, polyvinyl acetate, polyvinyl butyral, polyvinyl acetal, polyvinyl pyrrolidone and polyacrylamide, and polyester. Among these, resins based on cellulose, acetal, butyral and polyester are preferred in view of heat resistance, dye migration and other factors. If required, the dye layer may additionally contain other known additives.

Such a dye layer is formed by dissolving or dispersing the aforesaid sublimable dye and binder resin in a suitable solvent together with other subordinate components to prepare a dye layer forming-coating material or ink, and coating the coating material successively on the substrate film in the longitudinal direction, followed by drying. The dye layer has a thickness of about 0.2 μm to about 5.0 μm, preferably about 0.4 μm to about 2.0 μm upon formed. Preferably, the sublimable dye accounts for 5 to 90% by weight, esp., 10 to 70% by weight of the dye layer.

The relationship between the transferable resin layer containing the dye receiving layer component and the dye layer is not critical. By way of example but not by way of limitation, it is general that one unit is made up of the receiving layer component-containing transferable resin layer→Y→M→C→Bk→protective layer in this order. While the dye of each hue is usually provided on the same area, it is understood that the dye receiving layer component-containing transferable resin layer (or protective layer) may be formed on an area larger than usual, because it must often be transferred at least twice although depending on the type of thermal transfer image receiving sheet or the durability of the image demanded. The dye receiving layer component-containing transferable resin layer (or protective layer) may be formed following the procedure of forming the aforesaid dye receiving layer with the exception that it is formed successively on the surface of the substrate film in the longitudinal direction.

It is here to be noted that the transferable protective layer may be formed as in the case of the dye receiving layer mentioned above, and may dispense with any intermediate layer. The transferable protective layer must be transparent or semi-transparent, so that an image can be observed through it. The protective layer and the adhesive layer formed on its surface may also be similar to the aforesaid receiving layer in terms of material, how to form them, thickness, and the like.

By way of example but not by way of limitation, the associated or cooperative member on which the receiving layer is to be transferred for image formation using the aforesaid receiving layer transfer sheet that may or may not be of the integral type may be plain paper, wood free paper, tracing paper and plastic film sheets which may take card, postcard, passport, letter paper, report paper, note, catalogue or many other forms. The receiving layer transfer sheet of the invention is particularly applicable to coarse plain paper, and rough paper as well.

Transfer of the receiving layer and the protective layer may be achieved by use of heating and pressurizing means that can be heated to a temperature at which the adhesive layer is activated, for instance, generally available printers including a thermal head for thermal transfer purposes, hot stampers for transfer foils, and heated rolls.

All means so far known in the art may be used for image formation. For instance, the desired object can be well achieved by application of thermal energy of about 5 $mJ/mm^2$ to about 100 $mJ/mm^2$ using a thermal printer (e.g., Video Printer VY-100 made by Hitachi, Ltd.) while the recording time is controlled.

How to use the receiving layer transfer sheet of the invention and how to form an image according to the invention will now be explained.

For transfer of the dye receiving layer with the same thermal head, the surface of the adhesive layer component of the transferable resin layer formed in front of the yellow dye layer is opposed to and superposed on the cooperative member such as plain paper. Then, heat and/or pressure suitable for adhesion of the adhesive layer is applied through a thermal head to the entire back surface thereof. The heat and/or pressure cause the adhesive layer and the receiving layer to be transferred and bonded onto the cooperative member at the same time.

Then, the receiving layer transfer sheet is moved forward to align the yellow dye layer with the surface of the transferred dye receiving layer, so that heat corresponding to the thermal dye migration temperature of the dye layer is applied thereto through a thermal head in an imagewise pattern to form an yellow image. Next, imagewise transfer of the magenta and cyan dyes from the magenta and cyan dye layers is effected to form a full-color image on the dye receiving layer.

When the thermal head is used in combination with a transfer head for transfer of the receiving layer component-containing transferable resin layer, that transfer head is designed to be able to withstand intensive heat and/or high pressure. Then, the resin layer can be well transferred even onto a cooperative member having a coarse surface by making heating intensive and/or making pressure high. Of course, another pressing means such as pressing rolls may be used in place of the transfer head. Image formation is achieved as mentioned above.

Second Aspect

The second aspect of the invention will now be explained at great length with reference to some preferred embodiments.

In the receiving layer transfer sheet according to this aspect, a substrate film 1 is basically provided on one surface with a transferable resin layer comprising a dye receiving layer component 2 and an adhesive layer component 3, if necessary, with a release layer interleaved between said one surface and said resin layer, as shown in FIG. 1. If required, the substrate film 1 is provided with a releasable, heat-resistant lubricating layer (although not shown) on the other surface. This receiving layer transfer sheet is characterized in that the dye receiving layer 2 has a thickness of 0.1 μm to 1.0 μm and contains a filler 4.

In a preferable embodiment, an intermediate layer 5 such as a cushion or barrier layer can be interleaved between the dye receiving layer 2 and the adhesive layer 3.

The receiving layer transfer sheet according to the first aspect of the invention may also be designed as an integral type of composite thermal transfer sheet comprising a substrate film, on one surface of which a dye layer of one color, or dye layers of two or more colors such as yellow, magenta and cyan dye layers, possibly with a black dye layer, and/or a transferable protective layer are formed successively in the longitudinal direction with respect to the transferable resin layer containing the dye receiving layer component.

According to the invention, the coating solution for forming the dye receiving layer is coated in an amount of 0.1 $g/m^2$ to 2.0 $g/m^2$ on dry basis, so that the dye receiving layer can have a thickness of 0.1 μm to 1.0 μm. At the thickness of 0.1 μm to 1.0 μm the dye receiving layer is somewhat improved in terms of the ability to be cut off, but is likely to fuse with the dye layer during printing. This is the reason the filler is incorporated in the dye receiving layer. For instance, the filler may be Hydrotalcite DHT-4A (made by Kyowa Kagaku Kogyo Co., Ltd., Japan), Talc Microace L-1 (made by Nippon Talc Co., Ltd., Japan), Teflon Lubulon L-2 (made by Daikin Kogyo Co., Ltd., Japan), Graphite Fluoride SCP-10 (made by Sanpo Kagaku Kogyo Co., Ltd., Japan), and Graphite AT40S (made by Oriental Sangyo Co., Ltd., Japan), or fine particles such as silica powder, calcium carbonate powder, precipitated barium powder, crosslinked urea resin powder, crosslinked styrene-acrylic resin powder, crosslinked amino resin powder, silicone powder, wood meal, molybdenum disulfide powder, and boron nitride powder. However, since the dye receiving layer is preferably of white color, preference is given to using white or colorless fillers such as titanium oxide, zinc oxide, silica, calcium carbonate, and precipitated barium.

The aforesaid filler preferably accounts for 1% by weight to 50% by weight of the dye receiving layer. At less than 1% by weight, the filler is less effective for improving the ability to be cut, while the dye receiving layer has difficulty in transfer onto paper and is likely to fuse with the dye layer during printing. Too much filler causes the dye receiving layer to decrease in strength upon transfer, and this again makes the dye receiving layer likely to fuse with the dye layer during printing, and the ability of the dye receiving layer to receive the dye worse.

Figure 2:
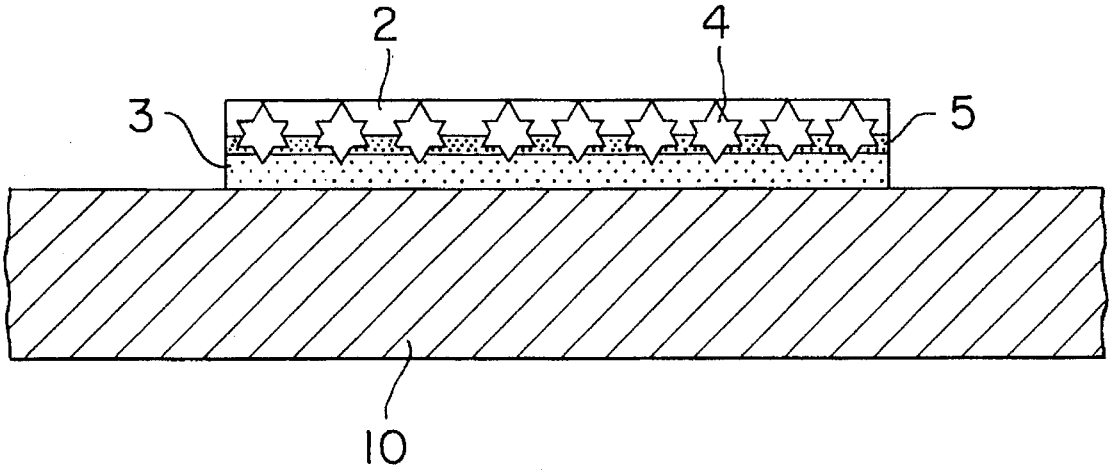
FIG. 2 is a sectional schematic that provides an illustration of how the receiving layer transfer sheet according to the second aspect of the invention is used to make transfer onto a cooperative member.

In a preferable embodiment, a filler having an average particle size larger than the thickness of the dye receiving layer is used as the filler mentioned above. Referring to the schematic view or FIG. 1, if the filler 4 added has an average particle size larger than the thickness of the dye receiving layer 2, the surface of the resulting dye receiving layer 2 then comes to having asperities. However, such asperities are found on the side of the dye receiving layer 2 located on the intermediate layer 5 or the adhesive layer 3, but not on the side of the dye receiving layer 2 located on the substrate film 1. With the method of producing the receiving layer transfer sheet in mind, this is taken as a matter of course. As can be seen from FIG. 2, therefore, the dye receiving layer 2 remains smooth on the surface even after transfer onto a cooperative member 10, so that the thermal head can work well for image formation. As the breaking strength of the dye receiving layer decreases due to the presence of the filler, the dye receiving layer can be well cut off by a thermal head upon transfer of the transferable resin layer, when a resin of relatively high tensile strength and heat resistance is used for the dye receiving layer. In addition, since the thickness of the intermediate or adhesive layer changes microscopically due to the presence of the filler, the dye receiving layer can be more satisfactorily cut off at a thin portion. The filler used has a particle size lying in the range of preferably 0.1 μm to 20 μm, more preferably 0.5 μm to 10 μm.

In the present invention, no particular limitation is imposed on the substrate film used; the same substrate film as so far used for conventional thermal transfer sheets is directly used, and other substrate films may be used as well.

Illustrative examples of preferable substrate films are tissue paper films such as those of glassine paper, condenser paper and paraffin paper, and plastic films such as those of polyester, polypropylene, cellophane, polycarbonate, cellulose acetate, polyethylene, polyvinyl chloride, polystyrene, nylon, polyimide, polyvinylidene chloride and ionomer, which may be used in composite forms with the paper films mentioned above.

Substrate film thickness is preferably 3 μm to 100 μm, although it may be varied depending on material to impart suitable properties such as strength and heat resistance thereto. The film may be in a continuous or cut sheet form.

Preferably, the substrate film mentioned above is provided on the other or back surface with a releasable, heat-resistant lubricating layer for the purposes of not only preventing its fusion with a thermal head and improving its running stability but also preventing its adhesion to the adhesive layer to be described later, when the receiving layer transfer sheet of the invention is rolled up.

The releasable, heat-resistant lubricating layer may be made of a release agent such as curing silicone oil, curing silicone wax, silicone resin, fluorocarbon resin, and acrylic resin, and may be formed at a thickness of about 0.1 μm to about 3 μm as in the case of the dye receiving layer component to be described later.

In the receiving layer transfer sheet of the invention, the dye receiving layer formed on the surface of the substrate film mentioned above is to receive the sublimable dye migrating from any thermal transfer image receiving layer upon transfer and maintain the formed image.

Prior to forming the receiving layer (or the protective layer), it is preferable to form a release layer on the surface of the substrate film. Such a release layer is formed of a release agent such as waxes, silicone wax, silicone resin, fluorocarbon resin, acrylic resin, urethane resin, and acetoacetal resin. In particular, it is preferable to use an urethane resin having a high glass transition point and it is more preferable to use 10 to 50 parts by weight of an acetoacetal resin in combination with 100 parts by weight of urethane.

The release layer may be formed at a thickness of about 0.5 μm to about 5 μm as in the case of the dye receiving layer. When matting is desired after transfer, the release layer is matted on the surface either by addition of various particles or by use of a substrate film which is matted on the surface on which the release layer is to be formed. When the substrate film mentioned above is of suitable releasability, it is of course unnecessary to form the release layer.

The resin forming the dye receiving layer is inferior to the resins forming other layers in terms of the ability to be cut; if the thickness of this layer is controlled, it is then possible to place the overall transferability of the tranferable resin layer under control. For the resin forming the dye receiving layer, for instance, mention is made of polyolefinic resins such as polypropylene, halogenated polymers such as polyvinyl chloride, vinyl chloride-vinyl acetate copolymers and polyvinylidene chloride, vinyl polymers such as polyvinyl acetate and polyacrylic ester, polyester resins such as polyethylene terephthalate and polybutylene terephthalate, polystyrene resins, poyamide resins, copolymeric resins such as those of olefins such as ethylene or propylene with other vinyl monomers, ionomers, cellulosic resins such as cellulose diacetate, and polycarbonate, with the vinyl and polyester resins being particularly preferred.

The release agent preferably used in admixture with the resin mentioned above, for instance, includes silicone oil, a phosphate surfactant and a fluorine surfactant, with the silicone oil being preferred. Preferably, the silicone oil has been modified or denatured with epoxy, alkyl, amino, carboxyl, alcohol, fluorine, alkyl aralkyl ether, epoxy-polyether, polyether, etc.

One or two or more such release agents are used. Preferably, such release agents are used in an amount of 0.5 to 30 parts by weight per 100 parts by weight of the dye receiving layer-forming resin. A departure from this range often results in a fusion of the thermal transfer sheet with the dye receiving layer, a lowering of printing sensitivity or other defects. Such release agents, when added to the dye receiving layer, bleed out on the surface of the receiving layer after transfer, thus forming a releasable, heat-resistant lubricating layer. It is also preferable to use fluorescent brighteners and ultraviolet absorbers.

The receiving layer is formed on one surface of the substrate film mentioned above, if required, with the release agent located between them, by the coating of a solution obtained by dissolving the resin mentioned above in a suitable organic solvent together with the required additives or dispersing the resin mentioned above in a suitable organic solvent or water together with the required additives as by gravure or screen printing or, in the alternative, reverse roll coating making use of a gravure plate, followed by drying.

The dye receiving layer formed as mentioned above may have a thickness of 0.1 μm (inclusive) to 1 μm (exclusive).

In the present invention, an adhesive layer is formed on the surface of the aforesaid receiving layer for the purpose of improving the transferability of the layers forming part of the receiving layer transfer sheet. For instance, the adhesive layer is formed of a pressure-sensitive adhesive material, a heat-sensitive adhesive material, and a tackifier, all known in the art. It is inter alia preferable to use a heat- or pressure-sensitive material that shows no adhesion at normal temperature or normal pressure, but exhibits adhesion force only upon heated or pressurized. Even when the resulting receiving layer transfer sheet is rolled up, it is most unlikely to offer the blocking problem with the back side of the substrate film.

The aforesaid heat- or pressure-sensitive adhesive material, for instance, is formed of resins having a relatively low melting point such as polyamide, acrylic, vinyl chloride-vinyl acetate copolymer, and polyester resins, or a mixture of these resins with a microcapsulated tackifier, and shows adhesion upon heated or exhibits good-enough tackiness upon pressurized to destroy the microcapsules. The tackifier used may be based on rubber, acrylic, and silicone systems, as well known in the art. Preferably, the adhesive layer has a thickness of about 0.5 μm to about 10 μm upon formed. The adhesive layer may additionally contain fillers such as silica, and calcium carbonate.

In the present invention, an intermediate layer or layers may be interleaved between the aforesaid receiving layer and the adhesive layer mentioned just above. For instance, the intermediate layer is formed of polyurethane, resins, acrylic resins, polyethylene resins, butadiene rubbers, and epoxy resins. Preferably, the intermediate layer has a thickness of about 2 μm to about 10 μm. The intermediate layer may be formed as in the case of the receiving layer mentioned above. The adhesive and intermediate layers mentioned above may additionally contain foams (or a foaming agent). The foams (or foaming agent) function to provide the receiving layer with a good-enough cushion.

When the foams or foaming agent are used, it is preferable to use a styrene-acrylic emulsion as the intermediate layer.

Preferably, the foaming agent is used in an amount of 50 to 200 parts by weight per 100 parts of resin.

For the foaming agent, mention is made of a decomposable type of foaming agent that is decomposed upon heated to generate oxygen, carbon dioxide, nitrogen, and other gases, such as dinitropentamethylenetetramine, diazoaminobenzene, azobisisobutyronitrile and azodicarboamide, microspheres obtained by microcapsuling a low-boiling liquid such as butane or pentane with resins such as polyvinylidene chloride or polyacrylonitrile, all well known in the art. Among others, it is preferable to use microspheres obtained by microcapsuling a low-boiling liquid such as butane or pentane with resins such as polyvinylidene chloride or polyacrylonitrile. These foaming agents are expanded upon heated, and show high cushion and heat insulation after expansion.

The intermediate layer containing the foaming agent or foams has preferably a thickness of 2 μm to 10 μm.

Preferably, the foaming agent has a particle size of 1 μm to 10 μm before expansion and 2 μm to 30 μm after expansion.

It is particularly preferable to use a low-temperature foaming type of microsphere with the wall-softening temperature and foam initiating temperature of up to 100° C. and the optimal foaming temperature of up to 140° C. (at which the highest expansion ratio is achieved by one-minute heating), because the heating temperature for foaming can be reduced as much as possible. By use of microspheres having a low foaming temperature it is possible to avoid thermal wrinkling or curling of the substrate upon foaming.

These microspheres having a low foaming temperature may be obtained by regulating the amount of thermoplastic resins such as polyvinylidene chloride or polyacrylonitrile used for wall formation.

The foamed layer obtained by use of such microspheres has some advantages, among which: closed foams are obtained by foaming, foaming is easy to occur at a simple step involving heating alone, and its thickness can be easily controlled by regulating the amount of the microspheres used.

However, this microsphere is readily attacked by an organic solvent; that is, when a coating solution containing an organic solvent is used to form the foamed layer, the microsphere is less foamable because its wall is attacked by the organic solvent. When such a microsphere as mentioned above is used, it is preferable to use an aqueous type of coating solution which is free from organic solvents that make an attack on its wall, for instance, ketones such as acetone, and methyl ethyl ketone; esters such as ethyl acetate; and lower alcohols such as methanol, and ethanol.

It is thus preferable to use an aqueous type of coating solution, specifically a coating solution or emulsion containing water-soluble or dispersible resin, more specifically an acrylic styrene emulsion, or a modified or denatured vinyl acetate emulsion.

Some aqueous coating solutions containing solvents of high boiling point and high polarity such as NMP, DMF, and Cellosolve as co-solvents, film-forming aids, and plasticizers are found to have an adverse influence on microspheres. It is then required to have a full understanding of the composition of the aqueous type of resin used and the amount of the high-boiling solvent added, and to confirm whether or not they have an adverse influence on microcapsules.

The adhesive or intermediate layer mentioned above may additionally contain white pigments, and fluorescent brighteners for the purpose of improving the whiteness of the receiving layer after transfer and concealing the pale yellow of paper that is a thermal transfer image receiving sheet. These additives inclusive of white pigments may have been incorporated in the coating solution used for forming each layer. In this case, it is required that the protective layer be transparent or semi-transparent.

When a foam or foaming agent containing layer such as one mentioned above is used as the intermediate layer, it is preferable to interleave a barrier layer between the receiving and intermediate layers. The barrier layer is provided to avoid an adverse influence that the asperities of the foamed layer has on the receiving layer. The barrier layer may be formed of various known resins, but it is preferably formed of acrylic resin.

Preferably, the barrier layer further contains a release agent such as a silicone compound, and a filler such as titanium oxide or calcium carbonate.

Preferably, the barrier layer has a thickness of about 1 μm to about 10 μm.

In the receiving layer transfer sheet according to the present invention, dye layers may be formed successively on the surface of the substrate film at a given interval in the longitudinal direction. Each of the dye layers is a layer in which the dye is carried by any desired binder resin. No particular limitation is placed on the dye used, because all dyes used for known thermal transfer sheets can be well used. By way of example but not by way of limitation, MS Red G, Macrolex Red Violet R, Ceres Red 7B, Samaron Red HBSL and Resolin Red F3BS are mentioned for red dyes; Phorone Brilliant Yellow 6GL, PTY-52 and Macrolex Yellow 6G for yellow dyes; and Kayaset Blue 714, Vaccsoline Blue AP-FW, Phorone Brilliant Blue S-R and MS Blue 100 for blue yellow.

All resins so far known in the art may be used as the aforesaid binder resin for carrying the dye. However, preference is given to cellulosic resins such as ethyl cellulose, hydroxyethyl cellulose, ethyl hydroxycellulose, hydroxypropyl cellulose, methyl cellulose, cellulose acetate and cellulose acetobutyrate, vinyl resins such as polyvinyl alcohol, polyvinyl acetate, polyvinyl butyral, polyvinyl acetal, polyvinyl pyrrolidone and polyacrylamide, and polyester. Among others, resins based on cellulose, acetal, butyral and polyester are preferred in view of heat resistance, dye migration and other factors. If required, the dye layer may additionally contain other known additives.

Such a dye layer is formed by dissolving or dispersing the aforesaid sublimable dye and binder resin in a suitable solvent together with other subordinate components to prepare a dye layer forming-coating material or ink, and coating the coating material successively on the substrate film in the longitudinal direction, followed by drying. The dye layer has a thickness of about 0.2 μm to about 5.0 μm, preferably about 0.4 μm to about 2.0 μm upon formed. Preferably, the sublimable dye accounts for 5 to 90% by weight, esp., 10 to 70% by weight of the dye layer.

The relationship between the transferable resin layer containing the dye receiving layer component and the dye layer is not critical. By way of example but not by way of limitation, it is general that one unit is made up of the receiving layer component-containing transferable resin layer→Y→M→C→Bk→protective layer in this order. While the dye of each hue is usually provided on the same area, it is understood that the dye receiving layer component-containing transferable resin layer (or protective layer) may be formed on an area larger than usual, because it must often be transferred at least twice although depending on the type of thermal transfer image receiving sheet or the durability of the image demanded. The dye receiving layer component-containing transferable resin layer (or protective layer) may be formed following the procedure of forming the aforesaid dye receiving layer with the exception that it is formed successively on the surface of the substrate film.

It is here to be noted that the transferable resin layer may be formed as in the case of the dye receiving layer mentioned above, and may dispense with any intermediate layer. The transferable protective layer must be transparent or semi-transparent, so that an image can be observed through it. The protective layer and the adhesive layer formed on its surface may also be similar to the aforesaid receiving layer in terms of material, how to form them, thickness, and the like.

By way of example but not by way of limitation, the associated member on which the receiving layer is to be transferred for image formation using the aforesaid receiving layer transfer sheet that may or may not be of the integral type may be plain paper, wood free paper, tracing paper and plastic film sheets which may take card, post card, passport, letter paper, report paper, note, catalogue or many other forms. The receiving layer transfer sheet of the invention is particularly applicable to coarse plain paper, and rough paper as well.

Transfer of the receiving layer and the protective layer may be achieved by use of heating and pressurizing means that can be heated to a temperature at which the adhesive layer is activated, for instance, generally available printers including a thermal head for thermal transfer purposes, hot stampers for transfer foil, and heated rolls.

All means so far known in the art may be used for image formation. For instance, the desired object can be well achieved by application of thermal energy of about 5 $mJ/mm^2$ to about 100 $mJ/mm^2$ using a thermal printer (e.g., Video Printer VY-100 made by Hitachi, Ltd.) while the recording time is controlled.

How to use the receiving layer transfer sheet of the invention and how to form an image according to the invention will now be explained.

For transfer of the dye receiving layer with the same thermal head, the surface of the adhesive layer component of the transferable resin layer formed in front of the yellow dye layer is opposed to and superposed on the cooperative member such as plain paper. Then, heat and/or pressure suitable for adhesion of the adhesive layer is applied through a thermal head to the entire back surface thereof. The heat and/or pressure cause the adhesive layer and the receiving layer to be transferred and bonded onto the cooperative member at the same time.

Then, the receiving layer transfer sheet is moved forward to align the yellow dye layer with the surface of the transferred dye receiving layer, so that heat corresponding to the thermal dye migration temperature of the dye layer is applied thereto through a thermal head in an imagewise pattern to form an yellow image. Next, imagewise transfer of the magenta and cyan dyes from the magenta and cyan dye layers is effected to form a full-color image on the dye receiving layer.

When the thermal head is used in combination with a transfer head for transfer of the receiving layer component-containing transferable resin layer, that transfer head is designed to be able to withstand intensive heat and/or high pressure. Then, the resin layer can be well transferred even onto a cooperative member having a coarse surface by making heating intensive and/or making pressure high. Of course, another pressing means such as pressing rolls may be used in place of the transfer head. Image formation is achieved as mentioned above.

Third Aspect

The third aspect of the invention will now be explained at great length with reference to some preferred embodiments.

In the receiving layer transfer sheet according to this aspect, a continuous substrate film is basically provided on one surface—which may or may not be provided with a release layer—with a transferable resin layer comprising a dye receiving layer component and an adhesive layer component, if necessary, with a releasable, heat-resistant lubricating layer on the other surface. The receiving layer transfer sheet according to this aspect is characterized in that the total amount of solvent residues in said transferable resin layer is up to 200 $mg/m^2$.

In a preferable embodiment, an intermediate layer such as a cushion or barrier layer can be interleaved between the dye receiving and adhesive layers.

The receiving layer transfer sheet according to the first aspect of the invention may also be designed as an integral type of composite thermal transfer sheet comprising a continuous substrate film, on one surface of which a dye layer of one color, or dye layers of two or more colors such as yellow, magenta and cyan dye layers, possibly with a black dye layer, and/or a transferable protective layer are formed successively in the longitudinal direction with respect to the transferable resin layer containing the dye receiving layer component.

The wording "the total amount of solvent residues" used in the present disclosure is understood to mean the amount of all solvent components inclusive of water that are present in all the layers forming the transferable resin layer plus the substrate film. When the total amount of solvent residues exceeds 200 $mg/m^2$, good-enough productivity is achieved but such problems as already mentioned arise. With productivity in mind, however, it is unavoidable that the solvent components are present in an amount of at least 5 $mg/m^2$. To make a reasonable compromise between the performance of the transferable resin layer and productivity, it is desired that the total amount of solvent residues be between 5 $mg/m^2$ and 200 $mg/m^2$.

The total thickness of the transferable resin layer, too, varies depending on what purpose the receiving layer transfer sheet is used for. It is thus required that a reasonable compromise be made between the total amount of solvent residues provided that it is up to 200 $mg/m^2$ and productivity, while consideration is taken into the thickness of the transferable protective layer. The present inventors have now found that it is preferable that $A/B<20$. Here A is the total amount in $mg/m^2$ of solvent residues in the transferable resin layer, and B is the thickness in μm of the transferable resin layer after transfer. More illustratively, this implies that if the transferable resin layer has a thickness of 3 μm to 30 μm, the total amount of solvent residues should then be 60 $mg/m^2$ to 200 $mg/m^2$.

The total amount of solvent residues as mentioned above may be easily controlled depending on the drying temperature and time for forming the transferable resin layer, the type of solvent used for preparing the coating solution, etc.

In the present invention, no particular limitation is imposed on the substrate film used; the same substrate film as so far used for conventional thermal transfer sheets is directly used, and other substrate films may be used as well.

Illustrative examples of preferable substrate films are tissue paper films such as those of glassine paper, condenser paper and paraffin paper, and plastic films such as those of polyester, polypropylene, cellophane, polycarbonate, cellulose acetate, polyethylene, polyvinyl chloride, polystyrene, nylon, polyamide, polyvinylidene chloride and ionomer, which may be used in composite forms with the paper films mentioned above.

Substrate film thickness is preferably 3 μm to 100 μm, although it may be varied depending on material to impart suitable properties such as strength and heat resistance thereto.

Preferably, the substrate film mentioned above is provided on the other or back surface with a releasable, heat-resistant lubricating layer for the purposes of not only preventing its fusion with a thermal head and improving its running stability but also preventing its adhesion to the adhesive layer component to be described later, when the receiving layer transfer sheet of the invention is rolled up.

The releasable, heat-resistant lubricating layer may be made of a release agent such as curing silicone oil, curing silicone wax, silicone resin, fluorocarbon resin, and acrylic resin, and may be formed at a thickness of about 0.1 μm to about 3 μm as in the case of the dye receiving layer component to be described later.

In the receiving layer transfer sheet of the invention, the dye receiving layer formed on the surface of the substrate film mentioned above is to receive the sublimable dye migrating from any thermal transfer image receiving layer upon transfer and maintain the formed image.

Prior to forming the receiving layer (or the protective layer), it is preferable to form a release layer on the surface of the substrate film. Such a release layer is formed of a release agent such as waxes, silicone wax, silicone resin, fluorocarbon resin, and acrylic resin.

The release layer may be formed at a thickness of about 0.5 μm to about 5 μm as in the case of the dye receiving layer. When matting is desired after transfer, the release layer is matted on the surface either by addition of various particles or by use of a substrate film which is matted on the surface on which the release layer is to be formed. When the substrate film mentioned above is of suitable releasability, it is of course unnecessary to form the release layer.

For the resin forming the dye receiving layer, for instance, mention is made of polyolefinic resins such as polypropylene, halogenated polymers such as polyvinyl chloride, vinyl chloride-vinyl acetate copolymers and polyvinylidene chloride, vinyl polymers such as polyvinyl acetate and polyacrylic ester, polyester resins such as polyethylene terephthalate and polybutylene terephthalate, polystyrene resins, poyamide resins, copolymeric resins such as those of olefins such as ethylene or propylene with other vinyl monomers, ionomers, cellulosic resins such as cellulose diacetate, and polycarbonate, with the vinyl and polyester resins being particularly preferred.

The release agent preferably used in admixture with the resin mentioned above, for instance, includes silicone oil, a phosphate surfactant and a fluorine surfactant, with the silicone oil being preferred. Preferably, the silicone oil has been modified or denatured with epoxy, alkyl, amino, carboxyl, alcohol, fluorine, alkyl aralkyl ether, epoxy-polyether, polyether, etc.

One or two or more such release agents are used. Preferably, such release agents are used in an amount of 0.5 to 30 parts by weight per 100 parts by weight of the dye receiving layer-forming resin. A departure from this range often results in a fusion of the thermal transfer sheet with the dye receiving layer, a lowering of printing sensitivity or other defects. Such release agents, when added to the dye receiving layer, bleed out on the surface of the receiving layer after transfer, thus forming a releasable, heat-resistant lubricating layer.

The receiving layer is formed on one surface of the substrate film mentioned above, if required, with the release layer located between them, by the coating of a solution obtained by dissolving the resin mentioned above in a suitable organic solvent together with the required additives or dispersing the resin mentioned above in a suitable organic solvent or water together with the required additives as by gravure or screen printing or, in the alternative, reverse roll coating making use of a gravure plate, followed by drying.

The dye receiving layer formed as mentioned above may have any desired thickness, but has generally a thickness of 1 μm to 10 μm. While it is preferable that such a dye receiving layer is a continuous coating, it is understood that it may be formed into a discontinuous coating by use of resin emulsion or resin dispersion techniques.

In the present invention, an adhesive layer is formed on the surface of the aforesaid receiving layer for the purpose of improving the transferability of the layers forming part of the receiving layer transfer sheet. For instance, the adhesive layer is formed of a pressure-sensitive adhesive material, a heat-sensitive adhesive material, and a tackifier, all known in the art. It is inter alia preferable to use a heat- or pressure-sensitive material that shows no adhesion at normal temperature or normal pressure, but exhibits adhesion force only upon heated or pressurized. Even when the resulting receiving layer transfer sheet is rolled up, it is most unlikely to offer the blocking problem with the back side of the substrate film.

The aforesaid heat- or pressure-sensitive adhesive material, for instance, is formed of resins having a relatively low melting point such as polyamide, acrylic, vinyl chloride-vinyl acetate copolymer, and polyester resins, or a mixture of these resins with a microcapsulated tackifier, and shows adhesion upon heated or exhibits good-enough tackiness upon pressurized to destroy the microcapsules. The tackifier used may be based on rubber, acrylic, and silicone systems, as well known in the art. Preferably, the adhesive layer has a thickness of about 0.5 μm to about 10 μm upon formed.

In the present invention, an intermediate layer or layers may be interleaved between the aforesaid receiving layer and the adhesive layer mentioned just above. For instance, the intermediate layer is formed of polyurethane, resins, acrylic resins, polyethylene resins, butadiene rubbers, and epoxy resins. Preferably, the intermediate layer has a thickness of about 2 μm to about 10 μm. The intermediate layer may be formed as in the case of the receiving layer mentioned above.

White pigments, fluorescent brighteners and/or a foam (or a foaming agent) may additionally be incorporated in the adhesive and intermediate layers mentioned above. The white pigments and fluorescent brighteners aid to improve the whiteness of the receiving layer upon transfer and conceal the pale yellow of paper that is a thermal transfer image receiving sheet. The foam or foaming agent functions to provide the receiving layer with a good-enough cushion. These additives inclusive of white pigments may have been incorporated in the coating solutions used to form the respective layers.

In the receiving layer transfer sheet according to the present invention, dye layers may be formed successively on the surface of the substrate film at a given interval in the longitudinal direction. Each of the dye layers is a layer in which the dye is carried by any desired binder resin. No particular limitation is placed on the dye used, because all dyes used for known thermal transfer sheets can be well used. By way of example but not by way of limitation, MS Red G, Macrolex Red Violet R, Ceres Red 7B, Samaron Red HBSL and Resolin Red F3BS are mentioned for red dyes; Phorone Brilliant Yellow 6GL, PTY-52 and Macrolex Yellow 6G for yellow dyes; and Kayaset Blue 714, Vacceline Blue AP-FW, Phorone Brilliant Blue S-R and MS Blue 100 for blue yellow.

All resins so far known in the art may be used as the aforesaid binder resin for carrying the dye. However, preference is given to cellulosic resins such as ethyl cellulose, hydroxyethyl cellulose, ethyl hydroxycellulose, hydroxypropyl cellulose, methyl cellulose, cellulose acetate and cellulose acetobutyrate, vinyl resins such as polyvinyl alcohol, polyvinyl acetate, polyvinyl butyral, polyvinyl acetal, polyvinyl pyrrolidone and polyacrylamide, and polyester. Among others, resins based on cellulose, acetal, butyral and polyester are preferred in view of heat resistance, dye migration and other factors. If required, the dye layer may additionally contain other known additives.

Such a dye layer is formed by dissolving or dispersing the aforesaid sublimable dye and binder resin in a suitable solvent together with other subordinate components to prepare a dye layer forming-coating material or ink, and coating the coating material successively on the substrate film in the longitudinal direction, followed by drying. The dye layer has a thickness of about 0.2 μm to about 5.0 μm, preferably about 0.4 μm to about 2.0 μm upon formed. Preferably, the sublimable dye accounts for 5 to 90% by weight, esp., 10 to 70% by weight of the dye layer.

The relationship between the transferable resin layer containing the dye receiving layer component and the dye layer is not critical. By way of example but not by way of limitation, it is general that one unit is made up of the receiving layer component-containing transferable resin layer→Y→M→C→Bk→protective layer in this order. While the dye of each hue is usually provided on the same area, it is understood that the dye receiving layer component-containing transferable resin layer (or protective layer) may be formed on an area larger than usual, because it must often be transferred at least twice although depending on the type of thermal transfer image receiving sheet or the durability of the image demanded. The dye receiving layer component-containing transferable resin layer (or protective layer) may be formed following the procedure of forming the aforesaid dye receiving layer with the exception that it is formed successively on the surface of the substrate film.

It is here to be noted that the transferable protective layer may be formed as in the case of the dye receiving layer mentioned above, and may dispense with any intermediate layer. The transferable protective layer must be transparent or semi-transparent, so that an image can be observed through it. The protective layer and the adhesive layer formed on its surface may also be similar to the aforesaid receiving layer in terms of material, how to form them, thickness, and the like.

By way of example but not by way of limitation, the associated member on which the receiving layer is to be transferred for image formation using the aforesaid receiving layer transfer sheet that may or may not be of the integral type may be plain paper, wood free paper, tracing paper and plastic film sheets which may take card, post card, passport, letter paper, report paper, note, catalogue or many other forms. The receiving layer transfer sheet of the invention is particularly applicable to coarse plain paper, and rough paper as well.

Transfer of the receiving layer and the protective layer may be achieved by use of heating and pressurizing means that can be heated to a temperature at which the adhesive layer is activated, for instance, generally available printers including a thermal head for thermal transfer purposes, hot stampers for foil transfer, and heated rolls.

All means so far known in the art may be used for image formation. For instance, the desired object can be well achieved by application of thermal energy of about 5 $mJ/mm^2$ to about 100 $mJ/mm^2$ using a thermal printer (e.g., Video Printer VY-100 made by Hitachi, Ltd.) while the recording time is controlled.

How to use the receiving layer transfer sheet of the invention and how to form an image according to the invention will now be explained.

For transfer of the dye receiving layer with the same thermal head, the surface of the adhesive layer component of the transferable resin layer formed in front of the yellow dye layer is opposed to and superposed on the cooperative member such as plain paper. Then, heat and/or pressure suitable for adhesion of the adhesive layer is applied through a thermal head to the entire back surface thereof. The heat and/or pressure cause the adhesive layer and the receiving layer to be transferred and bonded onto the cooperative member at the same time.

Then, the receiving layer transfer sheet is moved forward to align the yellow dye layer with the surface of the transferred dye receiving layer, so that heat corresponding to the thermal dye migration temperature of the dye layer is applied thereto through a thermal head in an imagewise pattern to form an yellow image. Next, imagewise transfer of the magenta and cyan dyes from the magenta and cyan dye layers is effected to form a full-color image on the dye receiving layer.

When the thermal head is used in combination with a transfer head for transfer of the receiving layer component-containing transferable resin layer, that transfer head is designed to be able to withstand intensive heat and/or high pressure. Then, the resin layer can be well transferred even onto a cooperative member having a coarse surface by making heating intensive and/or making pressure high. Of course, another pressing means such as pressing rolls may be used in place of the transfer head. Image formation is achieved as mentioned above.

The present invention will now be explained in more detail with reference to examples and comparative examples. Unless otherwise stated, parts or % are given on weight basis.

EXAMPLES A1–A8, EXAMPLES A10–A14, & COMPARATIVE EXAMPLES A1–A2

The following coating solutions were used to laminate release, dye receiving, intermediate, foamed and adhesive layers on one surface of a readily bondable, 6-μm thick polyethylene terephthalate film (Toray Industries, Inc.) at a width of 30 cm and an interval of 90 cm under the conditions shown in Table A1. Using a gravure coater, the following ink compositions for the dye layers were then coated successively on the other surface of the film in the longitudinal direction at the respective widths of 30 cm in the order of yellow, magenta and cyan to form coatings of 1.0 g/m$^2$ as measured upon drying, and dried to obtain composite thermal transfer sheets according to the present invention and for comparison purposes.

| | |
|---|---|
| **Composition of Coating Solution for Release Layer** | |
| Urethane resin (Krysbon 9004, DainipponInk & Chemicals, Inc.) | 100 parts |
| Acetoacetal resin (KS-5, Sekisui Chemical Co., Ltd.) | 30 parts |
| Dimethylformamide/methyl ethyl ketone (1/1) | 300 parts |
| (Coating weight: 0.3 g/m$^2$) | |
| **Composition of Coating Solution for Dye Receiving Layer** | |
| Vinyl chloride-vinyl acetate copolymer resin (1000AS, Denki Kagaku Kogyo K.K.) | 100 parts |
| Epoxy-modified silicone (KF-393, The Shin-Etsu Chemical Co., Ltd.) | 3 parts |
| Amino-modified silicone (KP-343, The Shin-Etsu Chemical Co., Ltd.) | 3 parts |
| Methyl ethyl ketone/toluene (1:1 weight ratio) | 400 parts |
| **Composition of Coating Solution for Intermediate Layer** | |
| Ethylene/vinyl acetate copolymer, aqueous varnish (AD-37P295, Toyo Morton Co., Ltd.) | 100 parts |
| Purified water | 100 parts |
| **Composition of Coating Solution for Foamed Layer** | |
| Styrene/acrylic copolymer emulsion (SX-606, Nippon Gosei Co., Ltd.) | 100 parts |
| Foamable microcapsules (F-30VS, Matsumoto Yushi Seiyaku Co., Ltd.) | 125 parts |
| Water | 100 parts |
| (Coating weight: 3.0 g/m$^2$) | |
| **Composition of Coating Solution for Adhesive-Layer** | |
| Adhesive material A shown in Table A1 | X parts |
| Adhesive material B shown in Table A1 | Y parts |
| Toluene/isopropyl alcohol (1/1) | 200 parts |
| **Composition of Ink for Yellow Dye Layer** | |
| Disperse dye (C.I. Disperse Yellow 201) | 4.0 parts |
| Ethylhydroxycellulose (Hercules) | 5.0 parts |
| Methyl ethyl ketone/toluene (1:1 weight ratio) | 80 parts |
| Dioxane | 10 parts |
| **Composition of Ink for Magenta Dye Layer** | |
| Disperse dye (C.I. Disperse Red 60) | 4.0 parts |
| Ethylhydroxycellulose (Hercules) | 5.0 parts |
| Methyl ethyl ketone/toluene (1:1 weight ratio) | 80 parts |
| Dioxane | 10 parts |
| **Composition of Ink for Cyan Dye Layer** | |
| Disperse dye (Kayaset Blue 714, Nippon Kayaku K.K.) | 4.0 parts |
| Ethylhydroxycellulose (Hercules) | 5.0 parts |
| Methyl ethyl ketone/toluene (1:1 weight ratio) | 80 parts |
| Dioxane | 10 parts |

EXAMPLE A9

Release, receiving, intermediate and foamed layers were laminated on one surface of film as in Examples A1–A8, and ink compositions for dye layers were formed on the other side of film in the order of yellow, magenta and cyan as in Examples A1–A8, thereby obtaining a composite thermal transfer sheet according to Example A9.

| | |
|---|---|
| **Composition of Coating Solution for Adhesive Layer** | |
| Adhesive material A shown in Table A1 | X parts |
| Adhesive material B shown in Table A1 | Y parts |
| Foamable microcapsules (F30VS, Matsumoto Yushi Seiyaku Co., Ltd.) | 30 parts |
| Toluene/isopropyl alcohol (1/1) | 200 parts |

TABLE A1

| | Receiving layer | Intermediate layer | Adhesive layer | Two adhesive materials A(X) Softening Temp. | B(Y) Softening Temp. |
|---|---|---|---|---|---|
| Ex. A1 | 3 | 3 | 3 | NL5005-30A (50) parts 125° C. | Macromelt 6239 (50) parts 140° C. |
| Ex. A2 | 3 | 3 | 3 | 750L (50) parts 89° C. | Eslec P (50) parts 125° C. |
| Ex.A3 | 3 | 3 | 3 | UE-3221 (50) parts 115° C. | Alonmelt 170V24 (50) parts 160° C. |
| Ex. A4 | 3 | 3 | 3 | 1000AS (50) parts 75° C. | Dianal BR-64 (50) parts 110° C. |
| Ex. A5 | 3 | 3 | 3 | Versamid 930 (50) parts 110° C. | Tomide #535 (50) parts 135° C. |
| Ex. A6 | 3 | 3 | 3 | Versamid 930 (60) parts 110° C. | Tomide #535 (40) parts 135° C. |
| Ex. A7 | 3 | 3 | 3 | Versamid 930 (40) parts 110° C. | Tomide #535 (60) parts 135° C. |
| Ex. A8 | 3 | 3 | 3 | Versamid 930 (70) parts 110° C. | Tomide #535 (30) parts 135° C. |
| Ex. A9 | 3 | 3 | 3 | Versamid 930 (50) parts 110° C. | Tomide #535 (50) parts 135° C. |
| Ex. A10 | 3 | 3 | 3 | 1000AS (50) parts 75° C. | 750L (50) parts 89° C. |
| Ex. A11 | 3 | 3 | 3 | Alonmelt 170V24 (50) parts 160° C. | Tomide 1360 (50) parts 170° C. |
| Ex. A12 | 3 | 3 | 3 | 1000AS (50) parts 75° C. | Tomide 1360 (50) parts 170° C. |
| Ex. A13 | 3 | 3 | 3 | Versamid 930 (45) parts 110° C. | Macromelt 6240 (45) parts 140° C. |
| Comp. Ex. A1 | 3 | 3 | 3 | Versamid 930 (100) parts 110° C. | — |
| Comp. Ex. A2 | 3 | 3 | 3 | — | Tomide #535 (100) parts 135° C. |

NL5005-30A:

Polyurethane resin, Mitui Toatsu Chemicals, Inc.

Marcomelt 6239: Polyamide resin, Henkel Hakusui K.K.

750L: Styrene resin, Denki Kagaku Kogyo K.K.

Eslec P: Styrene/acrylic copolymer resin, Sekisui Chemical Co., Ltd.

UE-3221: Polyester resin, Unitika Ltd.

Alonmelt 170V24: Polyester resin, Toa Gosei Kagaku K.K.

1000AS:

Vinyl chloride/vinyl acetate copolymer, Denki Kagaku Kogyo K.K.

Dianal BR-64: Acrylic resin, Mitsubishi Rayon Co., Ltd.

Versamid 930: Polyamide resin, Henkel Hakusui K.K.

Tomide #535: Polyamide resin, Fuji Kasei Kogyo K.K.

Tomide 1360: Polyamide resin, Fuji Kasei Kogyo K.K.

EXAMPLE A14

A transfer sheet of the following layer structure was prepared.

| | |
|---|---|
| **Adhesive Layer** | |
| Polyamide A (Versamid 930) | 15 parts |
| Polyamide B (Macromelt 6240) | |
| Foaming agent | 10 parts |
| Silica | 0.5 parts |
| **Foamed Layer** | |
| Acrylic emulsion with low Tg | 50 parts |
| Foaming agent | 80 parts |
| **Intermediate Layer** | |
| Amino-modified acrylic resin | 30 parts |
| Epoxy-modified silicone | 3 parts |

-continued

| | |
|---|---|
| Titanium oxide | 15 parts |
| Receiving Layer | |
| Low-molecular-weight vinyl chloride-acetate | 26 parts |
| Fluorescent brightener | 0.1 part |
| Calcium carbonate filler (Silton TC-20) | 9 parts |
| Carboxyl-modified silicone | 1.7 parts |
| Terminal-reactive silicone | 0.9 parts |
| Release Layer | |
| Polyurethane | 2.6 parts |
| Acetoacetal | 0.7 parts |
| Fluorescent brightener | 0.13 parts |
| Substrate Film | |
| Readily bondable, 6-μm thick PET film with a back side (6FK203EI Diafoil) | |
| This transfer film of the dye-combined type was transferred onto a government postcard. | |

Estimation

The transferable resin layer side of each of the receiving layer transfer sheets according to Examples A1–A4, Examples A10–A13 and Comparative Example A1 was put on a postcard to transfer the transferable resin layer thereto in the form of a 50 cm×50 cm square with the use of a thermal head under a certain applied energy. Subsequently, the yellow dye layer of a sublimation type of thermal transfer sheet having dye layers of three colors to form a yellow image using yellow signals obtained by the color separation of the original. The magenta and cyan dyes were then transferred onto the thus obtained image region by the magenta and cyan signals, respectively, thereby forming a full-color image. In the case of the composite thermal transfer sheets according to Examples A5–A9 and A14 as well as Comparative Example A5, it is to be noted that full-color images were obtained under the same conditions, using the dye layers of these sheets. These images were estimated in terms of quality and the "chipping" and "chattering" of the transferable resin layers. The results are set out in Table A2.

To make estimation of blocking resistance, each of the receiving layer transfer sheets was wound into a small roll form, allowed to stand alone at 60° C. for 4 days, and then rewound.

TABLE A2

| | Image Quality | Blocking Resistance | "Chipping" & "Chattering" |
|---|---|---|---|
| Ex. A1 | ○ | ○ | ○ |
| A2 | ○ | ○ | ○ |
| A3 | ○ | ○ | ○ |
| A4 | ○ | ○ | ○ |
| A5 | ○ | ○ | ○ |
| A6 | ○ | ○ | ○ |
| A7 | ○ | ○ | ○ |
| A8 | ○ | ○ | ○ |
| A9 | ⊙ | ○ | ○ |
| A10 | ○ | Δ | ○ |
| A11 | Δ | ○ | Δ |
| A12 | Δ | ○ | Δ |
| A13 | ⊙ | ○ | ○ |
| A14 | ⊙ | ○ | ○ |
| Comp. Ex. A1 | ○ | × | ○ |
| A2 | × | ○ | × |

Criteria for Estimation

Image Quality

⊙: A defect-free image was obtained at very high density.

○: A defect-free image was obtained at high density.

Δ: An image was defect-free but of low density.

×: A defective image was obtained at low density.

Blocking Resistance

○: No problem arouse during releasing.

Δ: Releasing made some noise.

×: Not released.

"Chipping" & "Dropping-out" of Transfer Layers

○: The receiving layer could be well transferred onto a given area.

Δ: The periphery of the transfer receiving layer was somewhat notched.

×: Nothing was transferred onto several spots.

EXAMPLES A13–A17

Receiving layer transfer sheets according to the present invention were obtained following Examples A1–A5 with the exception that no dye layer was used. The results of estimation made of these sheets were the same as in Examples A1–A5.

According to the present invention as described above, it is possible to provide a receiving layer transfer sheet wherein the adhesive layer is formed of two adhesive materials varying in softening point, so that no blocking problem arises during storage and in use, and wherein the range of reasonable adhesion temperature is so wide that good-enough transfer is achievable by application of relatively low energy even at the initial stage of transfer and the transferability of the transferable resin layer is not affected by an temperature increase in a printer, thus making uniform transfer possible and enabling high-quality images to be formed.

EXAMPLES B1–B4 & COMPARATIVE EXAMPLES B1–B2

The following coating solutions were used to laminate dye receiving, intermediate and adhesive layers on the surface of a 4.5-μm thick polyethylene terephthalate film (Toray Industries, Inc.) in this order and under the conditions shown in Table B1, thereby preparing receiving layer transfer sheets according to Examples B1–B4 and Comparative Examples B1–B2.

| Composition of Coating Solution for Dye Receiving Layer | |
|---|---|
| Vinyl chloride-vinyl acetate copolymer resin (1000AS, Denki Kagaku Kogyo K.K.) | 100 parts |
| Filler shown in Table B1 | X parts |
| Epoxy-modified silicone (KF-393, The Shin-Etsu Chemical Co., Ltd.) | 3 parts |
| Amino-modified silicone (KP-343, The Shin-Etsu Chemical Co., Ltd.) | 3 parts |
| Methyl ethyl ketone/toluene (1:1 weight ratio) | 400 parts |
| **Composition of Coating Solution for Intermediate Layer** | |
| Ethylene/vinyl acetate copolymer, aqueous varnish (AD-37P295, Toyo Morton Co., Ltd.) | 100 parts |
| Purified water | 100 parts |
| **Composition of Coating Solution for Adhesive Layer** | |
| Acrylic resin (BR-106, Mitsubishi Rayon Co., Ltd.) | 100 parts |
| Toluene/isopropyl alcohol (1/1) | 200 parts |

EXAMPLES B5–B8 & COMPARATIVE EXAMPLES B3–B5

Following Examples B1–B4, receiving, intermediate, and adhesive layers were formed on one surface of a substrate film at a width of 30 cm and an interval of 90 cm. Using a gravure coater, the following ink compositions for dye layers were then coated successively on the other surface of the film in the longitudinal direction at the respective widths of 30 cm in the order of yellow, magenta and cyan to form coatings of 1.0 g/m$^2$ as measured upon drying, and dried to obtain composite thermal transfer sheets according to Examples B5–B8 and Comparative Examples B3–B5.

| Composition of Ink for Yellow Dye Layer | |
|---|---|
| Disperse dye (C.I. Disperse Yellow 201) | 4.0 parts |
| Ethylhydroxycellulose (Hercules) | 5.0 parts |
| Methyl ethyl ketone/toluene (1:1 weight ratio) | 80.0 parts |
| Dioxane | 10.0 parts |
| **Composition of Ink for Magenta Dye Layer** | |
| Disperse dye (C.I. Disperse Red 60) | 4.0 parts |
| Ethylhydroxycellulose (Hercules) | 5.0 parts |
| Methyl ethyl ketone/toluene (1:1 weight ratio) | 80.0 parts |
| Dioxane | 10.0 parts |
| **Composition of Ink for Cyan Dye Layer** | |
| Disperse dye (Kayaset Blue 714, Nippon Kayaku K.K.) | 4.0 parts |
| Ethylhydroxycellulose (Hercules) | 5.0 parts |
| Methyl ethyl ketone/toluene (1:1 weight ratio) | 80.0 parts |
| Dioxane | 10.0 parts |

EXAMPLE B9

Following Examples B1–B4, receiving and intermediate layers together with the following adhesive layer were laminated on a substrate film to prepare a receiving layer transfer sheet according to Example B9.

| Composition of Coating Solution for Adhesive layer | |
|---|---|
| Acrylic resin (BR-106, Mitsubishi Rayon Co., Ltd.) | 100 parts |
| Foamable microcapsules (F30VS, Matsumoto Yushi Seiyaku K.K.) | 30 parts |
| Toluene/isopropyl alcohol (1/1) | 200 parts |

TABLE B1

| | Filler Type | Average Particle Size (μm) | Amount (X) | Thickness of Dye receiving layer (μm) |
|---|---|---|---|---|
| Ex. B1 | Calcium carbonate (Silver W, Shiraishi Kogyo Co., Ltd.) | 2.38 | 40 | 0.7 |
| Ex. B2 | Crosslinked polystyrene (Fine Pearl 3000SP, Sumitomo Chemical Co., Ltd.) | 6 | 15 | 0.7 |
| Ex. B3 | Silicone powder (Trefill E-500, Toray Dow Corning Co., Co., Ltd.) | 3 | 15 | 0.7 |
| Ex. B4 | Cellulose powder (Tosuko Flax Cellulose powder, Tosuko Co., Ltd.) | 10.0 | 10 | 0.9 |
| Ex. B5 | Silicon dioxide (Thyroid 79, Fuji Thyrysia Co., Ltd.) | 2.5 | 30 | 0.8 |
| Ex. B6 | Barium sulfate (precipitated barium sulfate #300, Sakai Kagaku Co., Ltd.) | 0.8 | 20 | 0.5 |
| Ex. B7 | Silicon dioxide (Thyroid 150, Fuji Thyrysia Co., Ltd.) | 1.4 | 20 | 0.8 |
| Ex. B8 | Calcium carbonate (Tsunex E, Shiraishi Co., Ltd.) | 0.5 | 20 | 0.7 |
| Ex. B9 | Calcium carbonate (Tsunex E, Shiraishi Co., Ltd.) | 0.5 | 30 | 0.8 |
| Ex. B10 | Calcium carbonate (Silton JC-20, Mizusawa Kagaku | 2.0 | 35 | 0.9 |

TABLE B1-continued

| | Filler Type | Average Particle Size (μm) | Amount (X) | Thickness of Dye receiving layer (μm) |
|---|---|---|---|---|
| | Co., Ltd.) | | | |
| Comp. Ex. B1 | No filler used | — | 0 | 2.0 |
| Comp. Ex. B2 | Silicon dioxide as in Ex. 7 | 1.4 | 20 | 1.8 |
| Comp. Ex. B3 | Calcium carbonate as in Ex. 8 | 0.5 | 20 | 1.5 |
| Comp. Ex. B4 | No filler used | — | 0 | 0.7 |

Particle size was measured by the Coulter counter method.

EXAMPLE B11

A transfer sheet of the following layer structure was prepared.

| | |
|---|---|
| **Adhesive Layer** | |
| Polyamide A (Versamid 930) | 15 parts |
| Polyamide B (Macromelt 6240) | |
| Foaming agent | 10 parts |
| Silica | 0.5 parts |
| **Foamed Layer** | |
| Acrylic emulsion with low Tg | 50 parts |
| Foaming agent | 80 parts |
| **Intermediate Layer** | |
| Amino-modified acrylic resin | 30 parts |
| Epoxy-modified silicone | 3 parts |
| Titanium oxide | 15 parts |
| **Receiving Layer** | |
| Low-molecular-weight vinyl chloride-acetate | 26 parts |
| Fluorescent brightener | 0.1 part |
| Calcium carbonate filler (Silton TC-20) | 9 parts |
| Carboxyl-modified silicone | 1.7 parts |
| Terminal-reactive silicone | 0.9 parts |
| **Release Layer** | |
| Polyurethane | 2.6 parts |
| Acetoacetal | 0.7 parts |
| Fluorescent brightener | 0.13 parts |
| **Substrate Film** | |
| Readily bondable, 6-μm thick PET film with a back side (6FK203EI Diafoil) | |
| This transfer film of the dye-combined type was transferred onto a government postcard. | |

Estimation

"Prinpa" made by Sony Corporation was used as a pritner. The transferable resin layer side of each of the receiving layer transfer sheets according to Examples B1–B10 and Comparative Example B1–B6 was put on a postcard to transfer the transferable resin layer thereto in the form of a 50 cm×50 cm square with the use of a transfer or thermal head under a certain applied energy. Subsequently, the yellow dye layer of a sublimation type of thermal transfer sheet having dye layers of three colors to form a yellow image using yellow signals obtained by the color separation of the original. The magenta and cyan dyes were then transferred onto the thus obtained image region by the magenta and cyan signals, respectively, thereby forming a full-color image. In the case of the composite thermal transfer sheets according to Examples B5–B8 and B11 as well as Comparative Examples B3–B5, it is to be noted that full-color images were obtained under the same conditions, using the dye layers of these sheets. These images were estimated in terms of the "chipping" and "dropping-out" of the transferable resin layers, thermal fusion with the dye layers, and image quality. The results are set out in Table B2.

TABLE B2

| | "Chipping" & "Chattering" | Thermal Fusion | Image Quality |
|---|---|---|---|
| Ex. B1 | ○ | ○ | ○ |
| B2 | ○ | ○ | ○ |
| B3 | ○ | ○ | ○ |
| B4 | ○ | ○ | ○ |
| B5 | ○ | ○ | ○ |
| B6 | ○ | ○ | ○ |
| B7 | ○ | ○ | ○ |
| B8 | ○ | ○ | ○ |
| B9 | ○ | ○ | ◎ |
| B10 | ○ | ○ | ◎ |
| B11 | ○ | ○ | ◎ |
| Comp. Ex. B1 | × | ○ | ○ |
| B2 | Δ | ○ | ○ |
| B3 | Δ | ○ | ○ |
| B4 | Δ | × | ○ |

EXAMPLES C1–C4 & COMPARATIVE EXAMPLES C1–C2

The following coating solutions were used to laminate dye receiving, intermediate and adhesive layers on the surface of a 4.5-μm thick polyethylene terephthalate film (Toray Industries, Inc.) to prepare receiving layer transfer sheets according to Examples C1–C4 and Comparative Examples C1–C2. Then, the amount of solvent residues and the value of A/B in the transferable resin layers were found. The results are set out in Table C1.

It is here to be noted that the amount of solvent residues was found by measuring the total amount of solvents in a laminate composed of a substrate polyethylene terephthalate film and a transferable resin layer laminated thereon and then measuring the amount of solvents in the substrate alone. The amount of solvent residues is expressed by a difference between the first-mentioned total amount and the second-mentioned amount. The measurements were obtained at 120° C. for 15 minutes, using a gas chromatography GC14-A made by Shimadzu Corporation.

| | |
|---|---|
| **Composition of Coating Solution for Dye Receiving Layer** | |
| Vinyl chloride-vinyl acetate copolymer resin (1000AS, Denki Kagaku Kogyo K.K.) | 100 parts |
| Epoxy-modified silicone (KF-393, The Shin-Etsu Chemical Co., Ltd.) | 3 parts |
| Amino-modified silicone (KP-343, The Shin-Etsu Chemical Co., Ltd.) | 3 parts |
| Methyl ethyl ketone/toluene (1:1 weight ratio) | 400 parts |
| **Composition of Coating Solution for Intermediate Layer** | |
| Ethylene/vinyl acetate copolymer, aqueous varnish (AD-37P295, Toyo Morton Co., Ltd.) | 100 parts |
| Purified water | 100 parts |
| **Composition of Coating Solution for Adhesive Layer** | |
| Acrylic resin (BR-106, Mitsubishi Rayon | 100 parts |

-continued

| | |
|---|---|
| Co., Ltd.) | |
| Toluene/isopropyl alcohol (1/1) | 200 parts |

EXAMPLE C5

Following Examples C1–C4, receiving, intermediate and adhesive layers were formed on one surface of a substrate film at a width of 30 cm and an interval of 90 cm. Using a gravure coater, the following ink compositions for dye layers were then coated successively on the other surface of the film in the longitudinal direction at the respective widths of 30 cm in the order of yellow, magenta and cyan to form coatings of 1.0 g/m$^2$ as measured upon drying, and dried to obtain a composite thermal transfer sheets according to Example C5. The amount of solvent residues and the value of A/B in the transferable resin layer were found. The results are set out in Table C1.

| Composition of Ink for Yellow Dye Layer | |
|---|---|
| Disperse dye (C.I. Disperse Yellow 201) | 4.0 parts |
| Ethylhydroxycellulose (Hercules) | 5.0 parts |
| Methyl ethyl ketone/toluene (1:1 weight ratio) | 80.0 parts |
| Dioxane | 10.0 parts |
| **Composition of Ink for Magenta Dye Layer** | |
| Disperse dye (C.I. Disperse Red 60) | 4.0 parts |
| Ethylhydroxycellulose (Hercules) | 5.0 parts |
| Methyl ethyl ketone/toluene (1:1 weight ratio) | 80.0 parts |
| Dioxane | 10.0 parts |
| **Composition of Ink for Cyan Dye Layer** | |
| Disperse dye (Kayaset Blue 714, Nippon Kayaku K.K.) | 4.0 parts |
| Ethylhydroxycellulose (Hercules) | 5.0 parts |
| Methyl ethyl ketone/toluene (1:1 weight ratio) | 80.0 parts |
| Dioxane | 10.0 parts |

TABLE C1

| | Coating weight (mg/m$^2$) | | | Drying conditions | | Amount of solvent residues | |
|---|---|---|---|---|---|---|---|
| | Receiving layer | Intermediate layer | Adhesive layer | Temp. | Time | (mg/m$^2$) | A/B |
| Ex. C1 | 3 | 2 | 2 | 100° C. | 1 min. | 100 | 14.3 |
| Ex. C2 | 3 | 2 | 2 | 120° C. | 3 min. | 50 | 7.1 |
| Ex. C3 | 1 | 1 | 1 | 100° C. | 1 min. | 40 | 13.3 |
| Ex. C4 | 1 | 1 | 1 | 100° C. | 3 min. | 20 | 6.7 |
| Ex. C5 | 3 | 2 | 2 | 80° C. | 1 min. | 200 | 28.6 |
| Comp. Ex. C1 | 3 | 2 | 2 | 80° C. | 20 sec. | 300 | 42.9 |
| Comp. Ex. C2 | 1 | 1 | 1 | 80° C. | 20 sec. | 210 | 70.0 |

Estimation

The transferable resin layer side of each of the receiving layer transfer sheets according to Examples C1–C4 and Comparative Example C1–C2 was put on a postcard to transfer the transferable resin layer thereto in the form of a 50 cm×50 cm square with the use of a transfer or thermal head. Subsequently, the yellow dye layer of a sublimation type of thermal transfer sheet having dye layers of three colors was put on the surface of the dye receiving layer to form a yellow image using yellow signals obtained by the color separation of the original. The magenta and cyan dyes were then transferred onto the thus obtained image region by the magenta and cyan signals, respectively, thereby forming a full-color image. In the case of the composite thermal transfer sheet according to Examples C5, it is to be noted that a full-color image was obtained under the same conditions, using the dye layer of these sheets. The "chipping" and "dropping-out" of the transferable resin layers, and thermal fusion with respect to the dye layers were estimated together with a change-with-time of the resulting images. For estimation of a change of the dye layers of the composite thermal transfer sheet of Comparative Example C5, the sheet was wound into a small roll, allowed to stand alone at 60° C. for 4 days, and rewound. The results are set out in Table C2.

TABLE C2

| | (A) | (B) | (C) | (D) |
|---|---|---|---|---|
| Example C1 | ○ | ○ | ○ | — |
| C2 | ◎ | ○ | ○ | — |
| C3 | ○ | ○ | ○ | — |
| C4 | ◎ | Δ | ○ | — |
| C5 | ○ | Δ | ○ | — |
| Comp. Ex. C1 | Δ | Δ | Δ | Δ |
| C2 | Δ | × | Δ | Δ |

Criteria for Estimation (A) Tailing Length

◎: less than 0.5 mm

○: less than 1.0 mm

Δ: less than 2.0 mm

×: more than 2.0 mm (B) Thermal Fusion

○: Satisfactory film release upon transfer of the receiving layer

Δ: Releasable, but with sticking

×: Not released with jamming (C) Change-With-Time of Image

○: The density change in the vicinity of the gray O.D. of 1.0 was within 5% after allowed to stand alone at 60° C. for 2 days.

Δ: The density change in the vicinity of the gray O.D. of 1.0 was within 1–10% after allowed to stand alone at 60° C. for 2 days.

×: The density change in the vicinity of the gray O.D. of 1.0 was more than 10% after allowed to stand alone at 60° C. for 2 days.

(D) Change of Dye Layer

Δ: Migration (strike-through) of dye to the back surface was observed.

By reducing the total amount of solvent residues in the transferable resin layer of the receiving layer transfer sheet to 200 mg/m$^2$ or less according to the present invention it is possible to achieve satisfactory transfer of the transferable resin layer without sacrificing productivity and giving rise to the problems mentioned above, thus making the formation of high-quality images possible.

What is claimed is:

1. A receiving layer transfer sheet comprising:

a substrate film; and a transferable resin laminate formed on one surface of said substrate film, said transferable resin laminate comprising a dye receiving layer formed on said substrate film and an adhesive layer formed on said dye receiving layer, wherein at least one layer of said transferable resin laminate contains at least one of a foam and a foaming agent, and said adhesive layer comprises a mixture of at least two heat-sensitive adhesive materials having varying softening temperatures.

2. The receiving layer transfer sheet of claim 1, further comprising an intermediate layer between said dye receiving layer and said adhesive layer.

3. The receiving layer transfer sheet of claim 1, further comprising a release layer between said substrate film and said transferable resin laminate.

4. The receiving layer transfer sheet of claim 1, wherein at least one of an outermost and second outermost layers of said transferable resin laminate contain at least one of a foam and a foaming agent.

5. The receiving layer transfer sheet of claim 1, wherein said adhesive layer comprises a mixture of at least two resins selected from the group consisting of polyurethane resin, polystyrene resin, styrene/acrylic copolymer resin, polyamide resin, and vinyl chloride/vinyl acetate copolymer resin.

6. The receiving layer transfer sheet of claim 1, wherein said adhesive layer comprises a first adhesive material having a softening temperature of 50° C. to 150° C., and a second adhesive material having a softening temperature of 100° C. to 200° C.

7. The receiving layer transfer sheet of claim 1, wherein said adhesive layer component comprises two adhesive materials with a softening temperature difference of 10° C. to 50° C. therebetween.

8. The receiving layer transfer sheet of claim 1, further comprising at least one dye layer formed on said one surface of said substrate film in the longitudinal direction thereof.

9. The receiving layer transfer sheet of claim 1, further comprising a transferable protective layer formed on said one surface of said substrate film in the longitudinal direction thereof.

10. A receiving layer transfer sheet comprising:

a substrate film; and a transferable resin laminate formed on one surface of said substrate film, said transferable resin laminate comprising a dye receiving layer formed on said substrate film and an adhesive layer formed on said dye receiving layer, wherein said dye receiving layer has a thickness in the range of 0.1 μm to 1.0 μm and contains a filler.

11. The receiving layer transfer sheet of claim 10, wherein said filler is present in an amount of 1% by weight to 50% by weight of said dye receiving layer.

12. The receiving layer transfer sheet of claim 10, wherein said transferable resin laminate further comprises at least one of a foam and a foaming agent.

13. The receiving layer transfer sheet of claim 10, wherein said filler has an average particle size larger than the thickness of said dye receiving layer.

14. The receiving layer transfer sheet of claim 10, further comprising at least one dye layer formed on said one surface of said substrate film in the longitudinal direction thereof.

15. The receiving layer transfer sheet of claim 10, further comprising a transferable protective layer formed on said one surface of said substrate film in the longitudinal direction thereof.

16. The receiving layer transfer sheet of claim 10, further comprising an intermediate layer between said dye receiving layer and said adhesive layer.

17. The receiving layer transfer sheet of claim 10, further comprising a release layer between said substrate film and said transferable resin laminate.

18. A receiving layer transfer sheet comprising:

a substrate film; and a transferable resin laminate formed on one surface of said substrate film, said transferable resin laminate comprising a dye receiving layer formed on said substrate film and an adhesive layer formed on said dye receiving layer, wherein the total amount of solvent residues in said transferable resin laminate is up to 200 mg/m$^2$.

19. The receiving layer transfer sheet of claim 18, wherein A is the total amount in mg/m$^2$ of solvent residues in said transferable resin laminate, B is the thickness in μm of the as-transferred transferable resin laminate, and $A/B<20$.

20. The receiving layer transfer sheet of claim 18, further comprising at least one dye layer formed on said one surface of said substrate film in the longitudinal direction thereof.

21. The receiving layer transfer sheet of claim 18, further comprising a transferable protective layer formed on said one surface of said substrate film in the longitudinal direction thereof.

22. The receiving layer transfer sheet of claim 18, further comprising an intermediate layer between said dye receiving layer and said adhesive layer.

23. The receiving layer transfer sheet of claim 18, further comprising a release layer between said substrate film and said transferable resin laminate.

* * * * *